US008845339B2

(12) United States Patent
Ono

(10) Patent No.: US 8,845,339 B2
(45) Date of Patent: Sep. 30, 2014

(54) CONNECTOR HAVING A HOUSING WITH A FITTING GUIDE FITTED WITH REINFORCING METAL FITTINGS

(71) Applicant: Molex Incorporated, Lisle, IL (US)

(72) Inventor: Yasuhiro Ono, Yamato (JP)

(73) Assignee: Molex Incorporated, Lisle, IL (US)

( * ) Notice: Subject to any disclaimer, the term of this patent is extended or adjusted under 35 U.S.C. 154(b) by 67 days.

(21) Appl. No.: 13/652,343

(22) Filed: Oct. 15, 2012

(65) Prior Publication Data

US 2013/0280926 A1 Oct. 24, 2013

(30) Foreign Application Priority Data

Oct. 14, 2011 (JP) ..... 2011-226896
Jul. 19, 2012 (JP) ..... 2012-160180

(51) Int. Cl.
*H01R 12/00* (2006.01)
*H01R 12/70* (2011.01)
*H01R 12/71* (2011.01)

(52) U.S. Cl.
CPC ..... *H01R 12/712* (2013.01); *H01R 12/7052* (2013.01)
USPC ..... 439/74

(58) Field of Classification Search
USPC ..... 439/65, 74, 660, 374, 358
See application file for complete search history.

(56) References Cited

U.S. PATENT DOCUMENTS

| | | | | |
|---|---|---|---|---|
| 6,491,538 | B2 | 12/2002 | Fenger | |
| 7,425,158 | B2 * | 9/2008 | Ookura | 439/660 |
| 7,901,218 | B2 | 3/2011 | Sato et al. | |
| 8,083,527 | B2 * | 12/2011 | Takeuchi et al. | 439/65 |
| 8,342,875 | B2 * | 1/2013 | Takeuchi | 439/374 |
| 8,398,425 | B2 * | 3/2013 | Suzuki et al. | 439/374 |
| 8,465,298 | B2 * | 6/2013 | Takeuchi et al. | 439/74 |
| 8,562,379 | B2 * | 10/2013 | Miyazaki et al. | 439/660 |
| 2004/0014335 | A1 * | 1/2004 | Igarashi et al. | 439/74 |
| 2005/0009383 | A1 * | 1/2005 | Okura et al. | 439/74 |

FOREIGN PATENT DOCUMENTS

| | | | |
|---|---|---|---|
| CN | 201243107 | Y | 5/2009 |
| CN | 101740975 | A | 6/2010 |

* cited by examiner

*Primary Examiner* — Chandrika Prasad
(74) *Attorney, Agent, or Firm* — Timothy M. Morella

(57) ABSTRACT

To provide a highly reliable board-to-board connector whereby the state of engagement between the first reinforcing metal fitting and the second reinforcing metal fitting can be reliably maintained and also the state of electrical continuity between the first reinforcing metal fitting and the second reinforcing metal fitting can be reliably maintained, and thus the fit between the first connector and second connector is reliably maintained.

11 Claims, 14 Drawing Sheets

Prior art

CONNECTOR HAVING A HOUSING WITH A FITTING GUIDE FITTED WITH REINFORCING METAL FITTINGS

REFERENCE TO RELATED APPLICATIONS

The Present Disclosure claims priority to prior-filed Japanese Patent Application Nos. 2012-160180, entitled "Connector," filed on 19 Jul. 2012 with the Japanese Patent Office (JPO), and 2011-226896, entitled "Connector," filed on 14 Oct. 2011 with the JPO. The content of each of the aforementioned Patent Applications is incorporated in their entireties herein.

BACKGROUND OF THE PRESENT DISCLOSURE

The Present Disclosure relates, generally, to a connector, and, more particularly, to a board-to-board connector having an improved and more reliable fit.

Conventionally, board-to-board connectors have been used in order to electrically connect parallel circuit boards. Such connectors are mounted to the mutually-facing surfaces of a pair of circuit boards, and engaged to achieve electrical continuity. In addition, a reinforcing metal fitting attached to each end functions as a locking member, thus maintaining the fitting with the other side of the connector in such technology. An example of this type of board-to-board connector is disclosed in Japanese Patent Application No. 2009-044980, the content of which is hereby incorporated by reference herein in its entirety.

FIGS. 14(*a*) and (*b*) are perspective diagrams illustrating the reinforcing metal fitting of a conventional board-to-board connector. In FIG. 14(*b*), 851 is a first reinforcing metal fitting attached at both ends in the longitudinal direction to the housing of a first connector mounted on a first circuit board (not shown). In FIG. 14(*a*), 951 is a second reinforcing metal fitting attached at both ends in the longitudinal direction to the housing of a second connector mounted on a second circuit board (not shown). First reinforcing metal fitting 851 is an integrally-formed conductive member, comprising (1) a sheet-like main body 852 extending in the direction of the width of the first connector; (2) securing board connection portions 856 that extend from both ends of the main body 852 in the longitudinal direction of the first connector and that are soldered to the first circuit board; (3) lateral engaging pieces 858 that extend upward from the ends of each of the board connection portions 856; (4) a lateral engaging indentation 858*a* that is formed on the front surface of the lateral engaging piece 858; (5) a curved central engaging piece 854 that is connected in the center of the main body 852; and (6) a central engaging edge 854*a* which is the front-end edge of the central engaging piece 854. Second reinforcing metal fitting 951 is also an integrally-formed conductive member, comprising: (1) a sheet-like main body 952 extending in the direction of the width of the second connector; (2) securing board connection portions 956 that extend from the lower edges of both ends of the main body 952 in the width direction of the first connector and that are soldered to the second circuit board; (3) lateral engaging pieces 958 that are formed on the shoulders at both sides of the main body 952; (4) a lateral engaging protrusion 958*a* that is formed on the side edge of the lateral engaging piece 958; (5) a curved central engaging piece 954 that is connected in the center of the main body 952; and (6) a central engaging protrusion 954*a* formed on the front surface of the central engaging piece 954.

When the first connector and the second connector are fit together, the lateral engaging pieces 858 and central engaging piece 854 and the lateral engaging pieces 958 and central engaging piece 954 engage each other. Specifically, the lateral engaging indentation 858*a* and the central engaging edge 854*a* and the lateral engaging protrusion 958*a* and central engaging protrusion 954*a* engage each other. Thereby, the first connector and second connector are locked together. Note that, at the time of fitting together, one of either the first reinforcing metal fitting 851 or the second reinforcing metal fitting 951 is placed upside-down compared to the orientation illustrated in FIGS. 14(*a*)-(*b*), and engages the other of the reinforcing metal fittings. In addition, the first reinforcing metal fitting 851 and the second reinforcing metal fitting 951 contact each other and achieve electrical continuity. Thus, by connecting the power line of the first circuit board to the board connection portions 856 and connecting the power line of the second circuit board to the board connection portions 956, the power line of the first circuit board is electrically connected to the power line of the second circuit board via the first reinforcing metal fitting 851 and the second reinforcing metal fitting 951.

SUMMARY OF THE PRESENT DISCLOSURE

However, in the aforementioned conventional connector, the lateral engaging pieces 858 and central engaging piece 854, and the lateral engaging pieces 958 and central engaging piece 954 are not provided with adequate flexibility. For this reason, when electronic equipment in which the first circuit board and second circuit board are mounted falls or is subject to external forces, giving rise to vibration or shock, this may be conveyed and momentary break the electrical continuity between the second reinforcing metal fitting 951 and the second reinforcing metal fitting 951, thus giving rise to the phenomenon called a momentary short.

In addition, the surface areas of the contacts between the lateral engaging indentation 858*a* and central engaging edge 854*a* and the lateral engaging protrusion 958*a* and central engaging protrusion 954*a* are extremely small, so the contact resistance between the first reinforcing metal fitting 851 and the second reinforcing metal fitting 951 becomes large. For this reason, there is a risk that, when large currents flow between the power line of the first circuit board and the power line of the second circuit board, the first reinforcing metal fitting 851 and the second reinforcing metal fitting 951 will heat up and become hot.

The Present Disclosure, thus, has an objective to solve the aforementioned problems and provide a highly reliable connector whereby, by giving the connection arms of a first reinforcing metal fitting a high flexibility and also securing a large surface area of contact, the state of engagement between the first reinforcing metal fitting and the second reinforcing metal fitting can be reliably maintained and also the state of electrical continuity between the first reinforcing metal fitting and the second reinforcing metal fitting can be reliably maintained. Thus, the fit between the first connector and second connector can be reliably maintained.

To this end, the connector according to the Present Disclosure includes (1) a first connector comprising a first terminal and a first housing that includes a first fitting guide portion formed at each end in the longitudinal direction; and (2) a second connector comprising a second terminal that contacts the first terminal and a second housing that includes a second fitting guide portion formed at each end in the longitudinal direction that fits to the first fitting guide portion. Further, a first reinforcing metal fitting and a second reinforcing metal fitting are attached to the first fitting guide portion and the second fitting guide portion. The second reinforcing metal fitting includes a second main body portion extending in the width direction of the second housing, and a pair of second side-plate portions that are connected to either end of the second main body portion and that extend in the longitudinal direction of the second housing. The first reinforcing metal fitting includes a first main body portion extending in the width direction of the first housing, a pair of first side-plate portions that are connected to either end of the first main body portion and that extend in the longitudinal direction of the first housing, and contact-arm portions that each connect to the first main body portion and first side-plate portions, respectively.

Further, each contact arm portions include an upper curved portion, a lower curved portion, a connection-arm portion that connects the upper curved portion and lower curved portion, and a flexibility-providing portion that reduces at least part of the width dimension of the upper curved portion and connection-arm portion. The curved convex surface of the lower curved portion is pressed against the surfaces of the second main body portion and second side-plate portion of the second reinforcing metal fitting.

In another aspect of the connector, the first reinforcing metal fitting further comprises a board connection portion having one end connected to a conductive trace of a board and the other end connected to each of the first main body portion and the side-plate portion, respectively. The other ends of the board connection portion are each connected to the first main body portion and first side-plate portion, respectively, at the same positions as the connection-arm portions when viewed from the side of the fitting surface of the first connector.

In still another aspect of the connector, the contact-arm portion is made of a belt-like plate member, and the curved convex surface of the lower curved portion extends in the width direction of the plate member and is in linear contact with the second main body portion and second side-plate portion of the second reinforcing metal fitting. In still another aspect of the connector, the flexibility-providing portion of the contact-arm portion connected to the first side-plate portion is formed upon at least part of the side edges of the upper curved portion and connection-arm portion, and at least a portion of the width dimensions of the upper curved portion and connection-arm portion decrease upon getting closer to the lower curved portion.

In still another aspect of the connector, the upper curved portion and connection-arm portion of the contact-arm portion connected to the first side-plate portion are wider than the upper curved portion and connection-arm portion of the contact-arm portion to which each is connected in the first side-plate portion, thereby producing an even greater pressing force. In still another aspect of the connector, the flexibility-providing portion of the contact-arm portion connected to the first side-plate portion is formed at least partially in the center in the width direction of the upper curved portion and connection-arm portion, being a long, thin, slit-shaped opening extending in the longitudinal direction of the contact-arm portion. In still another aspect of the connector, the distance from the start of contact of the curved convex surface of the lower curved portion of the contact-arm portion connected to the first main body portion with the surface of the second main-body portion of the second reinforcing metal fitting to the fitting surface of the first connector is different from the distance from the start of contact of the curved convex surface of the lower curved portion of the contact-arm portion connected to each of the first side-plate portions with the surface of the second side-plate portion of the second reinforcing metal fitting to the fitting surface of the first connector.

Pursuant to the Present Disclosure, the connector is given great flexibility in the connection-arm portion of the first reinforcing metal fitting and also a wide surface area of contact is secured. Thus, the state of engagement between the first reinforcing metal fitting and the second reinforcing metal fitting can be reliably maintained. Also, the state of electrical continuity between the first reinforcing metal fitting and the second reinforcing metal fitting can be reliably maintained, and the fitting between the first connector and second connector is reliably maintained Thus, reliability can be improved.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

Figure 1:
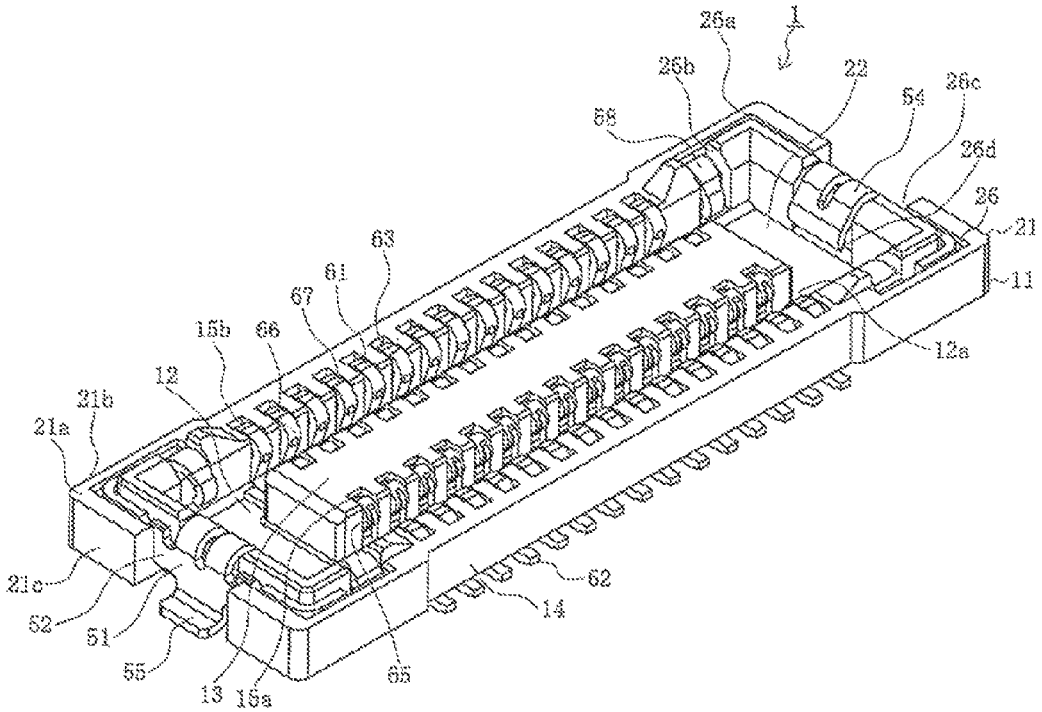
FIG. 1 is a perspective view of a connector, according to Embodiment 1 of the Present Disclosure, from the side of the fitting surface.
Figure 2A:
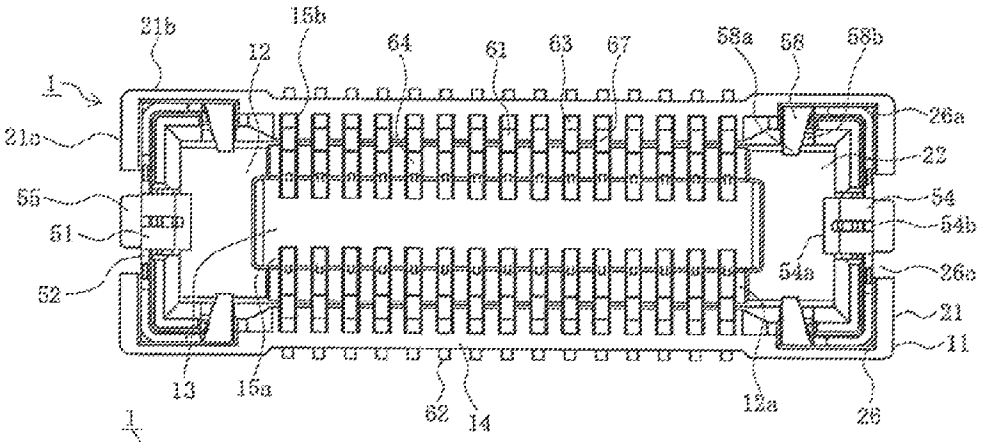
FIG. 2 is a four-view orthographic projection of the connector of FIG. 1, where (a) is a view from the top, (b) from the side, (c) from the bottom and (d) from the front.
Figure 2B:
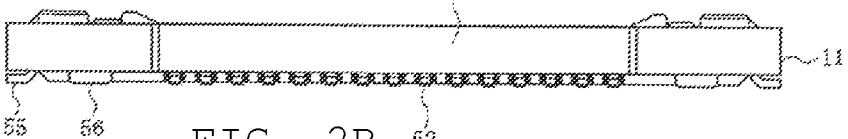
Figure 2C:
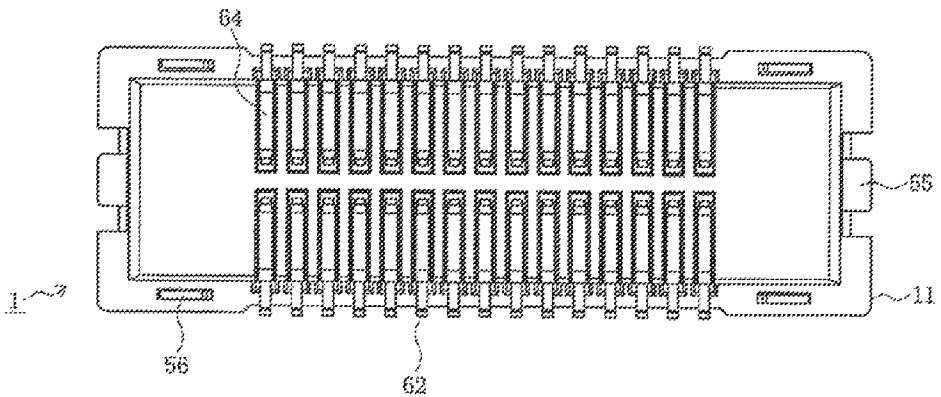
Figure 2D:
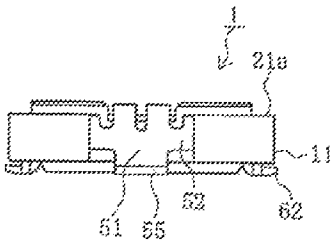
Figure 3B:
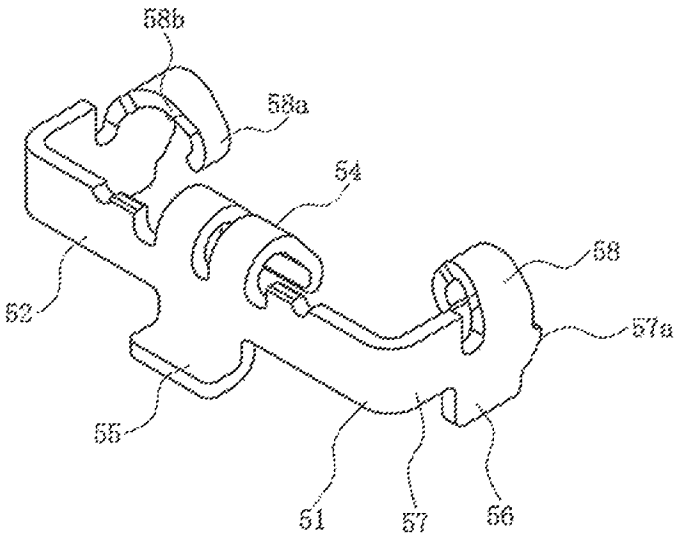
FIG. 3 is a perspective view of a first reinforcing metal fitting, according to Embodiment 1 of the Present Disclosure, where (a) is a front-upward oblique view and (b) is a back-upward oblique view.
Figure 3A:
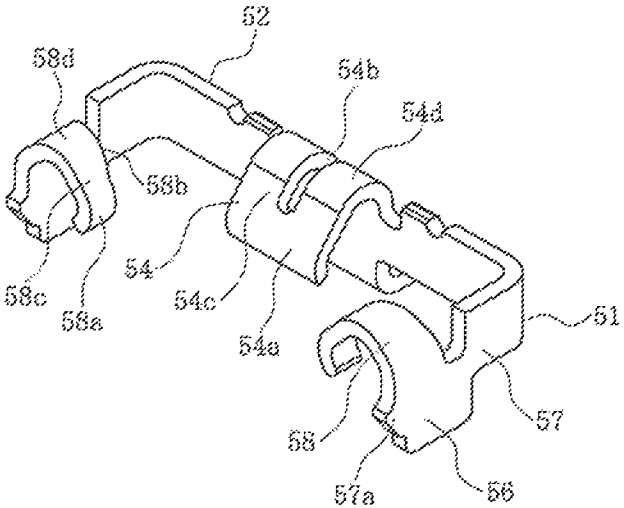
Figure 4:
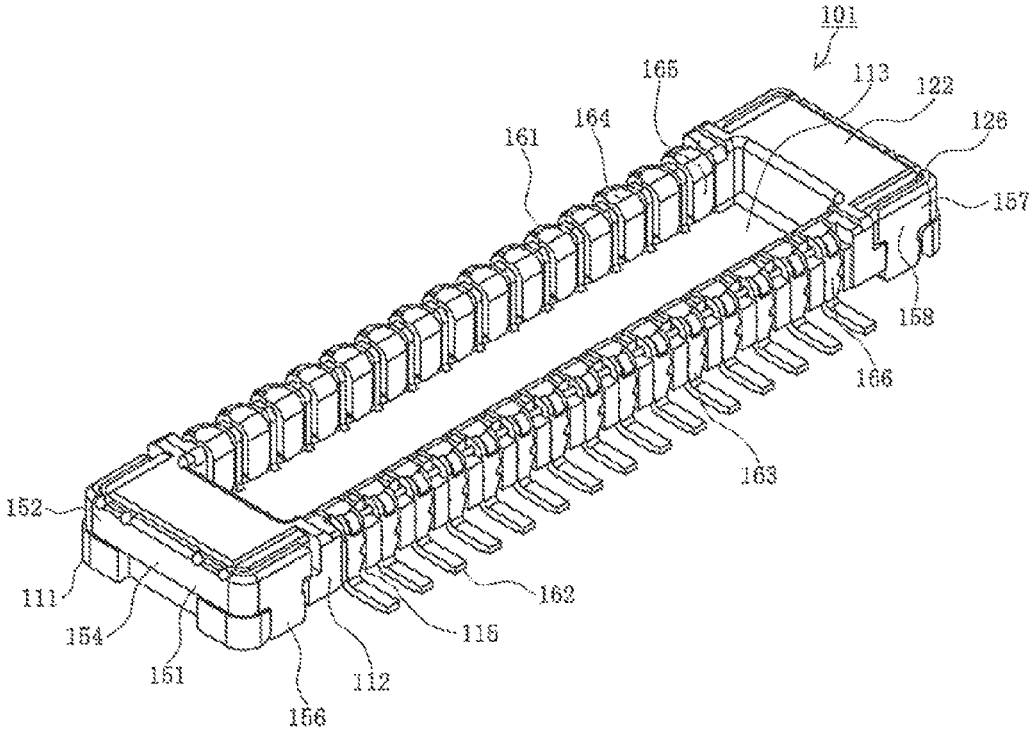
FIG. 4 is a perspective view of a first connector, according to Embodiment 2 of the Present Disclosure, from the side of the fitting surface.
Figure 5A:
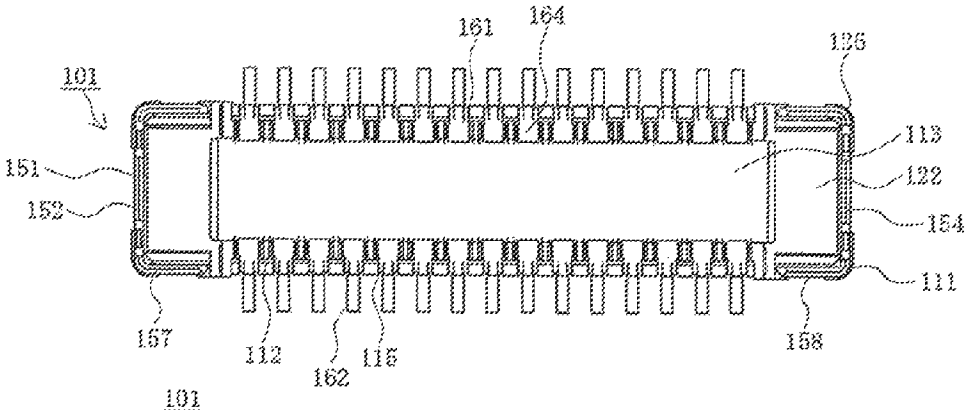
FIG. 5 is a four-view orthographic projection of the connector of FIG. 4, where (a) is a view from the top, (b) from the side, (c) from the bottom and (d) from the front.
Figure 5B:
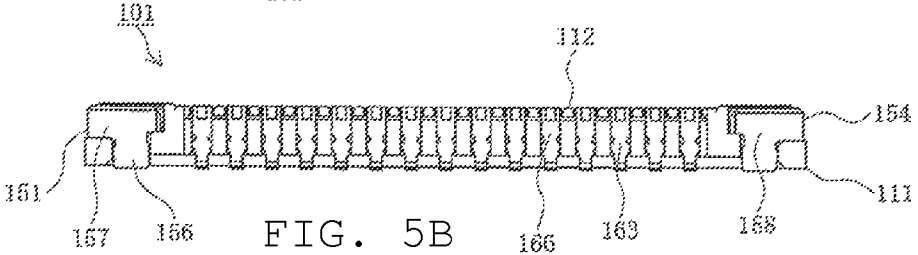
Figure 5C:
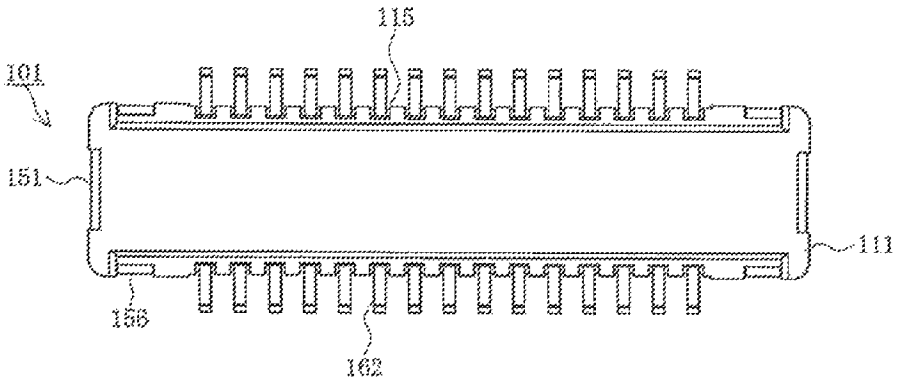
Figure 5D:
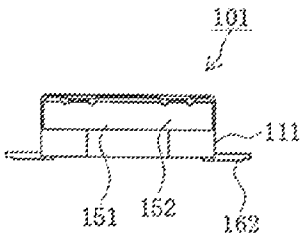
Figure 6B:
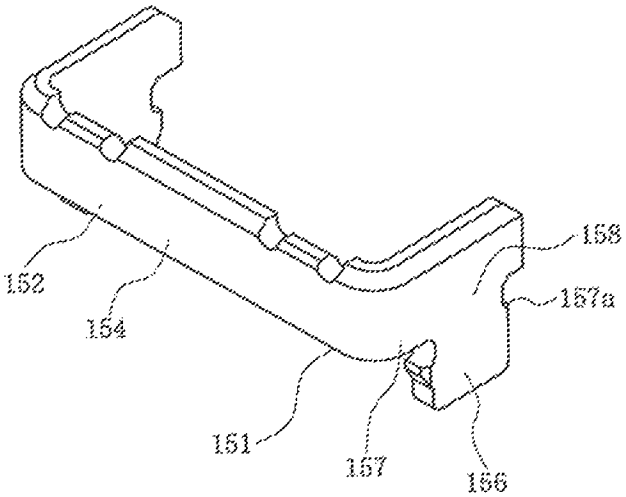
FIG. 6 is a perspective view of a first reinforcing metal fitting, according to Embodiment 2 of the Present Disclosure, where (a) is a front-upward oblique view and (b) is a back-upward oblique view.
Figure 6A:
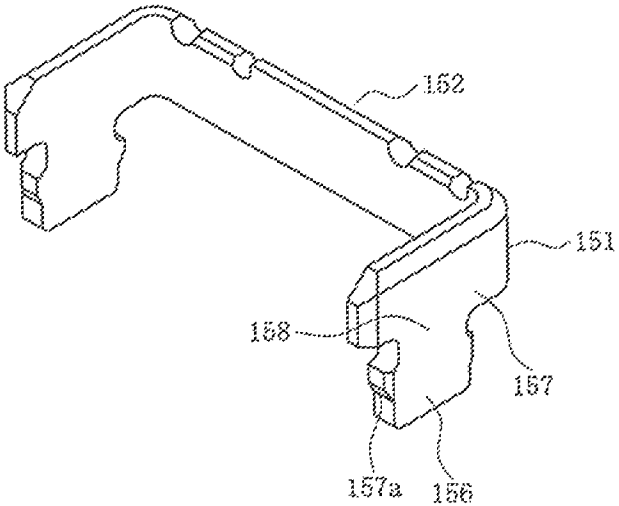

While the Present Disclosure may be susceptible to embodiment in different forms, there is shown in the Figures, and will be described herein in detail, specific embodiments, with the understanding that the Present Disclosure is to be considered an exemplification of the principles of the Present Disclosure, and is not intended to limit the Present Disclosure to that as illustrated.

As such, references to a feature or aspect are intended to describe a feature or aspect of an example of the Present Disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

With reference to the Figures, 1 is a first connector constituting one of a pair of board-to-board connectors which makes up the connector according to Embodiment 1. First connector 1 is a surface-mount connector mounted on the surface of a first board (not shown) as a mounted member, and mutually fit to a second connector 101 as the other connector. The second connector 101 is the other one of the pair of board-to-board connectors which makes up the connector according to this Embodiment, being a surface-mount connector mounted on the surface of a second board (not shown) as a mounted member. The connectors are typically called board-to-board connectors which include the aforementioned first connector 1 and second connector 101, and electrically connect a first board and a second board.

The first connector 1 has a first housing 11 as its connector body formed integrally with insulating material. As shown in the Figures, the first housing 11 has the shape of a substantially rectangular thick plate, thus being substantially a rectangular parallelepiped, and on the side into which the second connector 101 fits, or namely the fitting surface side (the top side in FIG. 2(*b*)) is formed a substantially rectangular indentation 12 with its periphery enclosed. A first protrusion 13 as an "island" is formed within the indentation 12, and also side walls 14 that extend parallel to the first protrusion 13 are formed integrally with the first housing 11 on either side of the first protrusion 13. In this case, the first protrusion 13 and side walls 14 protrude upward from the base of the indentation 12 and extend in the longitudinal direction of the first housing 11. Thereby, on either side of the first protrusion 13 is formed, as a portion of the indentation 12, a trench 12*a* which is a long, thin indentation extending in the longitudinal direction of the first housing 11, formed between the first protrusion 13 and the side walls 14.

Trench-shaped first terminal-enclosing inside cavities 15*a* are formed on the side walls on either side of the first protrusion 13. In addition, trench-shaped first terminal-enclosing outside cavities 15*b* are formed on the side walls on the inside of the side walls 14. Moreover, the first terminal-enclosing inside cavities 15*a* and first terminal-enclosing outside cavities 15*b* are linked and integrated with each other on the base of the trench 12*a*. Thus, when describing the first terminal-enclosing inside cavities 15*a* and first terminal-enclosing outside cavities 15*b* collectively, they are described as the first terminal-enclosing inside cavities 15.

Each of the first terminals 61 is an integrally-formed conductive member, comprising: a held portion 63, a tail portion 62 connected to the lower end of the held portion 63, an upper connection portion 67 connected to the upper end of the held portion 63, a second contact portion 66 formed in the vicinity of the inside end of the upper connection portion 67, a lower connection portion 64 connected to the second contact portion 66 and a first contact portion 65 formed in the vicinity of the free end of the lower connection portion 64. The held portion 63 is is fit into and held in the first terminal-enclosing outside cavities 15*b*, and extends in the up/down direction (that is, the direction of the thickness of the first housing 11). In addition, the tail portion 62 is bent and connected to the held portion 63, extending outward in the left/right direction (the direction of the width of the first housing 11), being connected to connection pads linked to the conductive traces of the first board. Note that the conductive traces are typically signal lines. Moreover, the upper connection portion 67 is bent toward and connected to the held portion 63, extending in the inward direction in the direction of the width of the first housing 11.

On the inside end of the upper connection portion 67 is formed a curving second contact portion 66 bent downward and protruding toward the inside in the direction of the width of the first housing 11. In addition, the lower connection portion 64 is a portion provided with a U-shaped side surface shape connected to the lower end of the second contact portion 66. The free end of the lower connection portion 64 is bent into a U-shape in the vicinity of the inside upper end, and thereupon is formed a curved first contact portion 65 that protrudes toward the outside in the direction of the width of the first housing 11.

The first terminals 61 are fit into the first terminal-enclosing inside cavities 15 from the mounting surface side (the bottom side in FIG. 2(*b*)) so that the held portion 63 is pinched from both sides between the side walls of the first terminal-enclosing outside cavities 15*b* formed on the side surfaces on the inside of the side walls 14, and thus secured to the first housing 11. In this state, in which the first terminals 61 are installed in the first housing 11, the first contact portion 65 and second contact portion 66 face each other, being positioned at the left and right sides of the trench 12*a*. Note that the first terminals 61 are formed integrally by the working of a metal sheet and are thus provided with a certain amount of elasticity. Moreover, as is clear from its shape, the gap between the first contact portion 65 and second contact portion 66 can change elastically. To wit, when the second terminals 161 (to be described later) of the second connector 101 are inserted between the first contact portion 65 and the second contact portion 66, the gap between the first contact portion 65 and the second contact portion 66 is elongated elastically.

At either end in the longitudinal direction of the first housing 11 is disposed a first thrust end portion 21 as a first fitting guide portion. On each first thrust end portion 21 is formed a thrust end indentation 22 as a portion of the aforementioned indentation 12. The thrust end indentation 22 is a substantially rectangular-shaped indentation, being connected to either end in the longitudinal direction of each trench 12*a*. Moreover, in the state in which the first connector 1 and second connector 101 are fit into each other, the thrust end indentation 22 functions as an insertion indentation into which the second thrust end indentation 122 (to be described later) of the second connector 101 is inserted.

The first thrust end portion 21 comprises a side-wall extension portion 21*b* which protrudes in the longitudinal direction from either end of the side walls 14 in the longitudinal direction of the first housing 11, and an end-wall portion 21*c* that has both ends connected to the side-wall extension portion 21*b*. At each first thrust end portion 21 the end-wall portion 21*c* and the side-wall extension portion 21*b* connected to each of its ends form a connected U-shaped side wall, thus demarcating three sides of the substantially rectangular thrust end indentation 22.

A first reinforcing metal fitting 51 as the reinforcing metal fitting is attached to the first thrust end portion 21. The first reinforcing metal fitting 51 is held and enclosed within a first metal fitting holding indentation 26 formed on the first thrust end portion 21. This first metal fitting holding indentation 26 has a contiguous U-shape when seen from the fitting surface side (the top side in FIG. 2(*b*)), being open at the upper surface 21*a* of the first thrust end portion 21 and being a slit-shaped space that protrudes downward from the upper surface 21*a* in the direction of the thickness of the first housing 11.

In this embodiment, the first reinforcing metal fitting 51 is an integrally-formed conductive member, comprising a long, thin belt-like first main body 52 extending in the direction of the width of the first housing 11; a first side-plate portion 57 extending in the longitudinal direction of the first housing 11; a first lateral board connection portion 56 as a board connection portion connected to the lower end of the first side-plate portion 57; a first lateral contact arm portion 58 as the contact arm portion connected to the upper end of the first side-plate portion 57; a first central board connection portion 55 as the board connection portion connected to the lower end of the first main body 52 in the center; and a first central contact arm portion 54 as the contact arm portion connected to the upper end of the first main body 52 in the center. The first main body 52 and the first side-plate portions 57 connected to both the left and right ends of this first main body 52 constitutes a continuous integral U-shaped member when viewed from the fitting surface side, while a first lock-stop portion 57*a* having a concavo-convex shape is formed upon the free end of the first side-plate portion 57. In addition, the first lateral board connection portion 56 is a plate-shaped member that extends upon the same plane as the first side-plate portion 57, its lower end being connected to connection pads linked to the conductive traces of the first board. Note that the conductive traces are typically power lines.

The first lateral contact arm portion 58 is connected to the upper end of the first side-plate portion 57 directly above the first lateral board connection portion 56. To wit, the first lateral contact arm portion 58 and the first lateral board connection portion 56 are connected to the first side-plate portion 57 at substantially the same position when seen from the fitting surface side. Moreover, the first lateral contact arm portion 58 which is a curved belt-shaped plate member, when moving from the base end connected to the first side-plate portion 57 toward its tip end, advances stepwise inwards in the direction of the width of the first housing 11, further advances stepwise in the direction of the mounting surface (downward), and further advances stepwise outwards in the direction of the width of the first housing 11, and finally the free end advances obliquely in the direction of the mounting surface (downward) and flexes so as to advance outward in the direction of the width of the first housing 11. To wit, the first lateral contact arm portion 58 is broadly divided into an upper curved portion 58*d* that has one end connected to the upper end of the first side-plate portion 57 and that has a curved convex surface pointing upward; a substantially planar connection arm portion 58*c* that has its upper end connected to the other end of this upper curved portion 58*d* and that extends obliquely downward in the inward direction in the direction of width of the first housing 11, and a lower curved portion 58*a* having a curved convex surface that has its upper end connected to the lower end of the connection arm portion 58*c* and that advances in the inward direction in the direction of the width of the first housing 11.

In the state in which the first and second connectors 1, 101 are fit together, the lower curved portion 58*a* functions as a first metal fitting contact portion that contacts a second reinforcing metal fitting 151 (to be described later) of this second connector 101. In addition, in the process of the first connector 1 and second connector 101 fitting together, the connection arm portion 58*c* functions as a first metal fitting guide portion that guides the second reinforcing metal fitting 151. Moreover, the connection arm portion 58*c* and upper curved portion 58*d* function as a flexible spring portion that is able to flexibly and elastically deform, thus making the lower curved portion 58*a* able to flexibly, or pliably, deform and thus the lower curved portion 58*a* is able to reliably maintain the contact with the second reinforcing metal fitting 151.

Note that, as shown in FIG. 2(*a*), the first lateral contact arm portion 58, which is a curved belt-shaped plate member, is formed so that its width dimension decreases stepwise when going from the base end connected to the first side-plate portion 57 toward its tip end. Specifically, a flexibility-providing portion 58*b* is formed on the side edges of the connection arm portion 58*c* and upper curved portion 58*d* toward the first main body 52, and for this reason, the side edges become oblique. In this manner, the flexibility-providing portion 58*b* is formed and the width dimensions of the connection arm portion 58*c* and upper curved portion 58*d* decrease as they approach the lower curved portion 58*a*. Thus, the connection arm portion 58*c* and upper curved portion 58*d* have high flexibility and the lower curved portion 58*a* can be displaced flexibly. In addition, the first central board connection portion 55 is a curved belt-shaped plate member whose base end extends upon the same plane as the first side-plate portion 57 and also whose free end advances toward the outside in the longitudinal direction of the first housing 11. Moreover, the lower end of the free end being connected by soldering or the like to connection pads linked to the conductive traces of the first board. Note that the conductive traces are typically power lines.

The first central contact arm portion 54 is connected to the upper end of the first main body 52 directly above the first central board connection portion 55. To wit, the first central contact arm portion 54 and the first central board connection portion 55 are connected to the first main body 52 at substantially the same position when seen from the fitting surface side. Moreover, the first central contact arm portion 54 which is a curved belt-shaped plate member, when moving from the base end connected to the first main body 52 toward its tip end, advances stepwise inwards in the direction of the width of the first housing 11, further advances stepwise in the direction of the mounting surface (downward), and further advances stepwise outwards in the direction of the width of the first housing 11, and finally the free end advances obliquely in the direction of the mounting surface (downward) and flexes so as to advance outward in the direction of the width of the first housing 11. To wit, the first central contact arm portion 54 is broadly divided into an upper curved portion 54*d* that has one end connected to the upper end of the first main body 52 and that has a curved convex surface pointing upward; a substantially planar connection arm portion 54*c* that has its upper end connected to the other end of this upper curved portion 54*d* and that extends obliquely downward in the inward direction in the direction of width of the first housing 11, and a lower curved portion 54*a* having a curved convex surface that has its upper end connected to the lower end of this connection arm portion 54*c* and that advances in the inward direction in the direction of the width of the first housing 11.

When the first connector 1 and the second connector 101 are fit together, the lower curved portion 54*a* functions as a first metal fitting contact portion that contacts a second reinforcing metal fitting 151 of this second connector 101. In addition, in the process of the first connector 1 and second connector 101 fitting together, the connection arm portion 54*c* functions as a first metal fitting guide portion that guides the second reinforcing metal fitting 151. Moreover, the connection arm portion 54*c* and upper curved portion 54*d* function as a flexible spring portion that is able to flexibly and elastically deform, thus making the lower curved portion 54*a* able to flexibly, or namely pliably, deform and thus the lower curved portion 54*a* is able to reliably maintain the contact with the second reinforcing metal fitting 151.

Note that the first central contact arm portion 54, a curved belt-shaped plate member, is formed so that its width dimension decreases stepwise when going from the base end connected to the first main body 52 toward its tip end. Specifically, a flexibility-providing portion 54*b* is formed in the center in the width direction on the connection arm portion 54*c* and upper curved portion 54*d*. This flexibility-providing portion 54*b* is a long, thin, slit-shaped opening extending in the longitudinal direction of the first central contact arm portion 54, and is formed so as to penetrate the first central contact arm portion 54 in the direction of its thickness. In this manner, in the portion where the flexibility-providing portion 54*b* is formed, the width dimensions of the connection arm portion 54*c* and upper curved portion 54*d* which function as the flexible spring portions decrease substantially, so the connection arm portion 54*c* and upper curved portion 54*d* have high flexibility and thus the lower curved portion 54*a* is able to be displaced flexibly.

The first metal fitting holding indentation 26 comprises: a continuous groove-shaped outside end portion-enclosing portion 26*a* that extends in the direction of the thickness of the first housing 11 and in a direction along the center axis of a U-shaped side wall formed by the end-wall portion 21*c* and the side-wall extension portions 21*b* connected to its two ends; a lateral contact arm portion-enclosing opening 26*b* that is linked to this outside end portion-enclosing portion 26*a* and that opens to the inside surface of the side-wall extension portion 21*b* so that at least a portion of the first lateral contact arm portion 58 can be exposed within the thrust end indentation 22; a central board connection portion-enclosing opening 26*c* that is linked to the outside end portion-enclosing portion 26*a* and that opens to the outside surface of end-wall portion 21*c* so that at least a portion of the first central board connection portion 55 can be visually inspected from outside; and a central contact arm portion-enclosing opening 26*d* that is linked to the outside end portion-enclosing portion 26*a* and that opens to the inside surface of the end-wall portion 21*c* so that at least a portion of the first central contact arm portion 54 can be exposed within the thrust end indentation 22.

Note that when the first reinforcing metal fitting 51 is attached to the first thrust end portion 21, nearly the entire thing is enclosed within the first metal fitting holding indentation 26. At least a portion of the left and right first lateral contact arm portions 58 is exposed to the inside of the side-wall extension portion 21*b*, at least a portion of the first central board connection portion 55 is exposed to the outside of the end-wall portion 21*c* and at least a portion of the first central contact arm portion 54 is exposed to the inside of the end-wall portion 21*c*.

The second connector 101 has a second housing 111 as its connector body formed integrally with insulating material. As shown in the Figures, the second housing 111 has the shape of a substantially rectangular thick plate, thus being substantially a rectangular parallelepiped. Moreover, on the side of the second housing 111 into which the first connector 1 fits, or namely the fitting surface side (the top side in FIG. 5(*b*)) are integrally formed a long, thin trench 113 extending in the longitudinal direction of the second housing 111, and a second protrusion 112 as a long, thin protrusion that demarcates the outside of this trench 113 and also extends in the longitudinal direction of the second housing 111. This second protrusion 112 is formed along both sides of the trench 113 and also along both sides of the second housing 111. In addition, the second protrusion 112 is provided with trench-shaped second terminal-enclosing inside cavities 115 formed so as to continuously straddle the side surfaces on the inside of the second protrusion 112, the upper surface of the second protrusion 112 and the side surfaces on the outside of the second protrusion 112. Moreover, the second terminals 161 as terminals are enclosed and mounted within each of the second terminal-enclosing inside cavities 115. As shown in the Figures, the trench 113 is closed by the base on the side that is mounted onto the second board, or namely on the side of the mounting surface (the bottom surface in FIG. 5(*b*)).

Each of the second terminals 161 is an integrally-formed conductive member, comprising a held portion 163, a tail portion 162 connected to the lower end of the held portion 163, a connection portion 164 connected to the upper end of the held portion 163, a first contact portion 165 connected to the inside end of this connection portion 164 and a second contact portion 166 formed on the surface of the outside of the held portion 163. Moreover, the second terminals 161 are fit into the interior of the second terminal-enclosing inside cavities 115, where the held portion 163 is enclosed within the portion formed on the inside surface of the outside of the second protrusion 112 in the second terminal-enclosing inside cavities 115, so that it is pinched from both sides between its side walls, and thus secured to the second housing 111. In this state, in which the second terminals 161 are mounted in the second housing 111, the surfaces of the first contact portion 165, connection portion 164 and second contact portion 166 are in the state of being exposed to the various side surfaces of the second protrusion 112 and the fitting surface. In addition, the tail portion 162 extends outward toward the second housing 111 and is connected to connection pads linked to the conductive traces of the second board. Note that the conductive traces are typically signal lines.

At either end in the longitudinal direction of the first housing 11 is disposed a second thrust end portion 122 as a second fitting guide portion. This second thrust end portion 122 extends in the direction of the width of the second housing 111 and is a thicker member with both ends connected to both ends of the second protrusion 112 in the longitudinal direction, and its upper surface is provided with a substantially rectangular shape. Moreover, when the first connector 1 and second connector 101 are fit into each other, the second thrust end portion 122 functions as an insertion protrusion that is inserted into the thrust end indentation 22 of the first thrust end portion 21 of the first connector 1.

A second reinforcing metal fitting 151 as the reinforcing metal fitting is attached to the second thrust end portion 122. The second reinforcing metal fitting 151 is held and enclosed within a second metal fitting holding indentation 126 formed on the second thrust end portion 122 disposed along the outside surfaces of the second housing 111 in the second thrust end portion 122. The second reinforcing metal fitting 151 is an integrally-formed conductive member, comprising a long, thin belt-like second main body 152 extending in the direction of the width of the second housing 111; a second side-plate portion 157 extending in the longitudinal direction of the second housing 111; and a second lateral board connection portion 156 as a board connection portion connected to the lower end of the second side-plate portion 157.

The second main body 152 and the second side-plate portions 157 connected to both the left and right ends of this second main body 152 constitutes a continuous integral U-shaped member when viewed from the fitting surface side, while a second lock-stop portion 157*a* having a concavo-convex shape is formed upon the free end of the second side-plate portion 157. In addition, the second lateral board connection portion 156 is a plate-shaped member that extends upon the same plane as the second side-plate portion 157, its lower end being connected by soldering or the like to connection pads linked to the conductive traces of the first board. Note that the conductive traces are typically power lines.

Note that the second reinforcing metal fitting 151 is attached to the second thrust end portion 122 so as to cover at least a portion of the outside surface of the second thrust end portion 122, and so that the outside surfaces of the second main body 152, second side-plate portion 157 and second lateral board connection portion 156 are exposed to the outside of the second thrust end portion 122. Moreover, in the state in which the first connector 1 and the second connector 101 are fit together, the outside surface of the center portion of the second main body 152 functions as a second central contact arm portion 154 that contacts the first central contact arm portion 54 of the first reinforcing metal fitting 51. In addition, when the first connector 1 and the second connector 101 are fit together, the outside surface of the second side-plate portion 157 functions as a second lateral contact arm portion 158 that contacts the first lateral contact arm portion 58 of the first reinforcing metal fitting 51. Note that when describing the second central contact arm portion 154 and second lateral contact arm portion 158 collectively, they are described as the contact arm portions.

To fit the first connector 1 and second connector 101, let first connector 1 have the tail portion 62 of the first terminals 61 be connected to connection pads linked to the conductive traces of the first board (not shown) and also the first lateral board connection portion 56 and first central board connection portion 55 of the first reinforcing metal fitting 51 be connected to connection pads linked to the conductive traces of the first board and thus mounted to the surface of the first board. Note that the conductive traces linked to connection pads connected to the tail portion 62 are typically signal lines, while the conductive traces linked to connection pads connected to the first lateral board connection portion 56 and first central board connection portion 55 are typically power lines. Similarly, let second connector 101 have the tail portion 162 of the second terminals 161 be connected to connection pads linked to the conductive traces of the second board (not shown) and also the second lateral board connection portion 156 of the second reinforcing metal fitting 151 be connected to connection pads linked to the conductive traces of the second board and thus mounted to the surface of the second board. Note that the conductive traces linked to connection pads connected to the tail portion 162 are typically signal lines, while the conductive traces linked to connection pads connected to the second lateral board connection portion 156 are typically power lines.

Figure 7A:
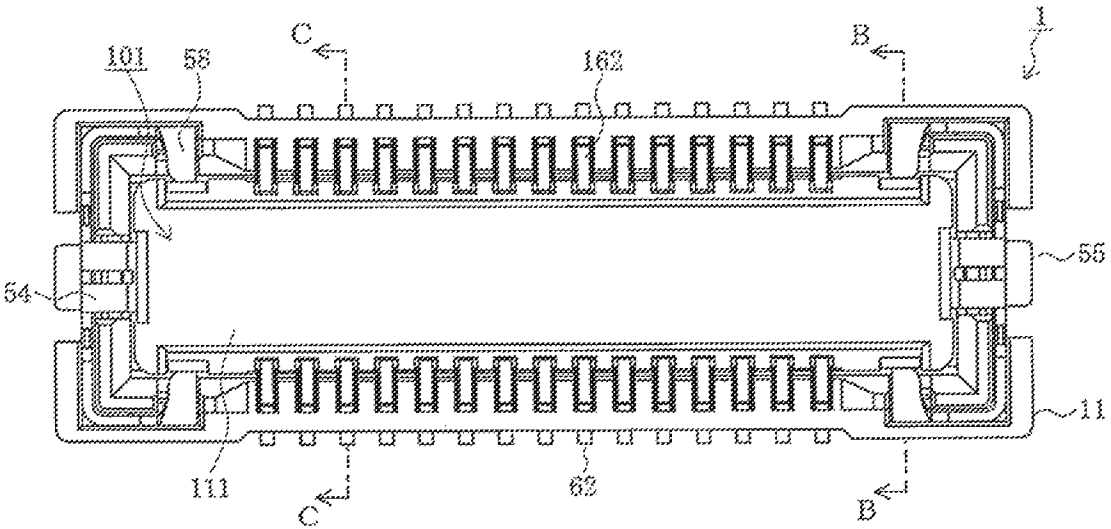
FIG. 7 is a three-view orthographic projection of the connector of FIG. 1 and a second connector fit to each other, according to Embodiment 1 of the Present Disclosure, where (a) is a top view, (b) is a side view and (c) is a front view.
Figure 7B:
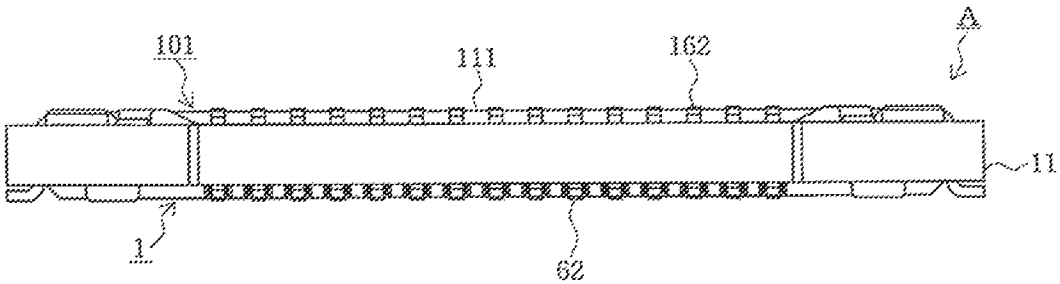
Figure 7C:
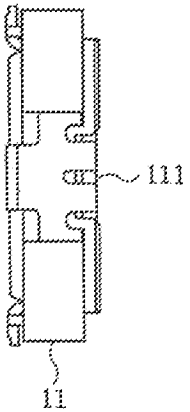

First, the operator places the fitting side of the first connector 1 so that it faces the fitting side of the second connector 101, aligns the position of the second protrusion 112 of the second connector 101 with the position of the corresponding trench 12*a* of the first connector 1, and aligns the position of the second thrust end portion 122 of the second connector 101 with the corresponding position of the thrust end indentation 22 of first connector 1, thereby completing the positioning of the first connector 1 and the second connector 101. In this state, when the first connector 1 and/or the second connector 101 is moved in the direction of approaching the other side, or namely in the direction of fitting together, the second protrusion 112 and the second thrust end portion 122 of the second connector 101 is inserted within the trench 12*a* and thrust end indentation 22 of the first connector 1. Thereby, as shown in FIG. 7, the fitting together of the first connector 1 and the second connector 101 is complete, and thus electrical continuity is achieved between the first terminals 61 and the second terminals 161.

Figure 10:
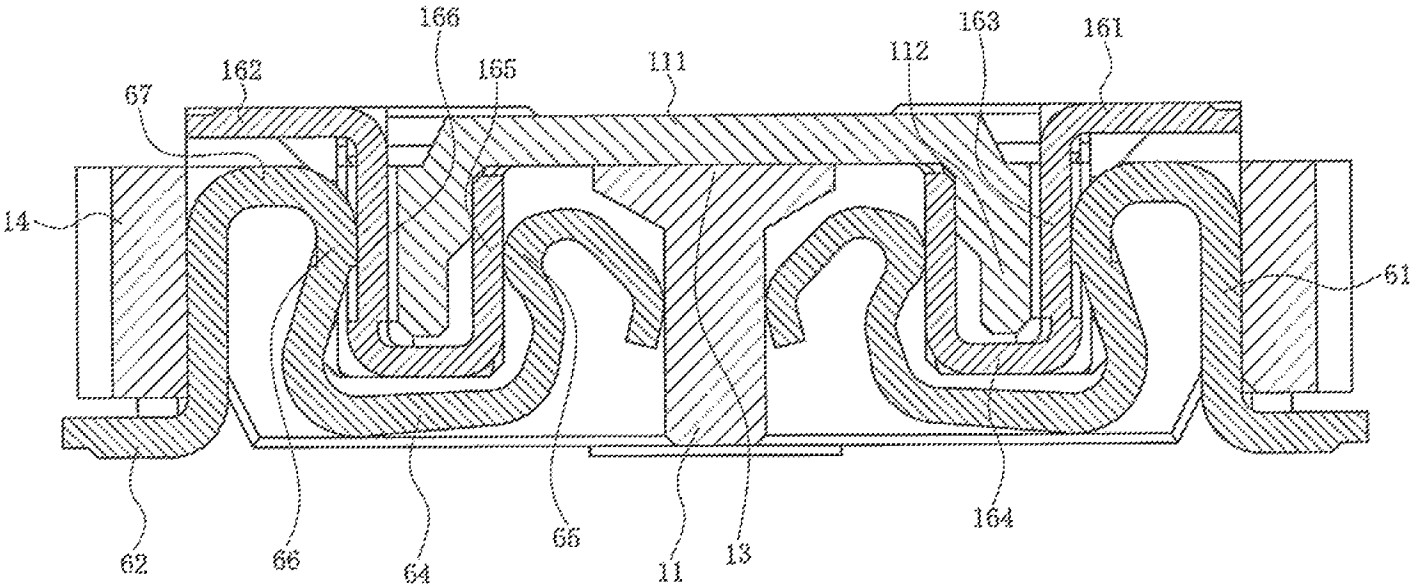
FIG. 10 Figure is a cross-sectional view at Arrows C-C in FIG. 7 illustrating an enlargement of a portion of the first connector and second connector fit to each other.

As shown in FIG. 10 in more detail, when the second terminals 161 of the second connector 101 are inserted between the first contact portion 65 and second contact portion 66 of each of the first terminals 61, the first contact portions 65 of the first terminals 61 come into contact with the first contact portions 165 of the second terminals 161, and the second contact portions 66 of the first terminals 61 come into contact with the second contact portions 166 of the second terminals 161. As a result, the conductive traces linked to connection pads upon the first board to which the tail portions 62 of the first terminals 61 are connected achieve electrical continuity with the conductive traces linked to connection pads upon the second board to which the tail portions 162 of the second terminals 161 are connected. In this case, there is multipoint contact between the first terminals 61 and the second terminals 161, so the state of electrical continuity is reliably maintained.

Figure 8:
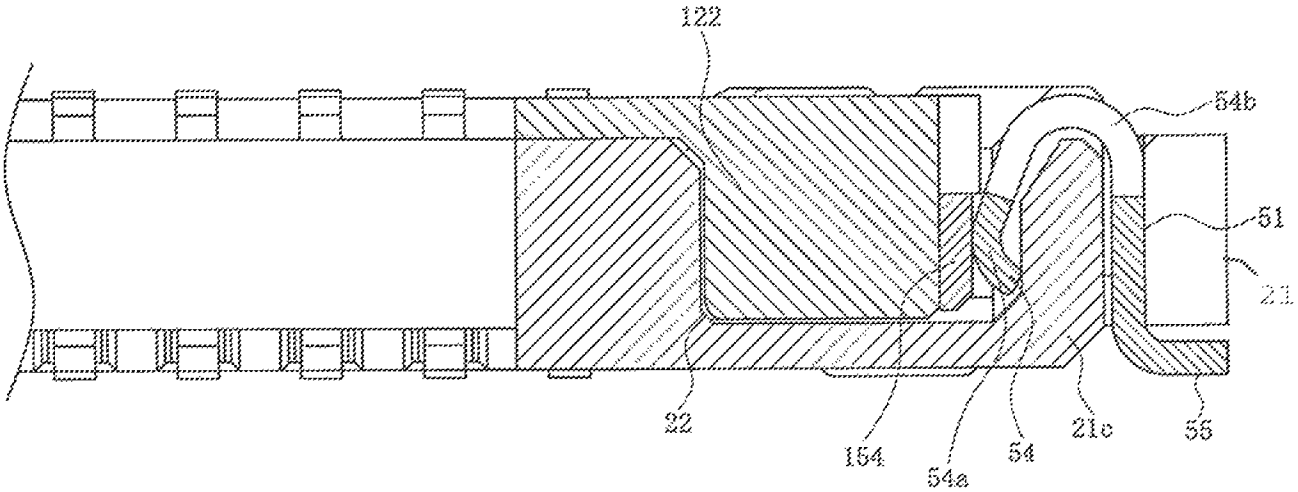
FIG. 8 is a cross-sectional side view at Arrows A-A of FIG. 7 illustrating an enlargement of a portion of the first connector and second connector fit to each other.
Figure 9:
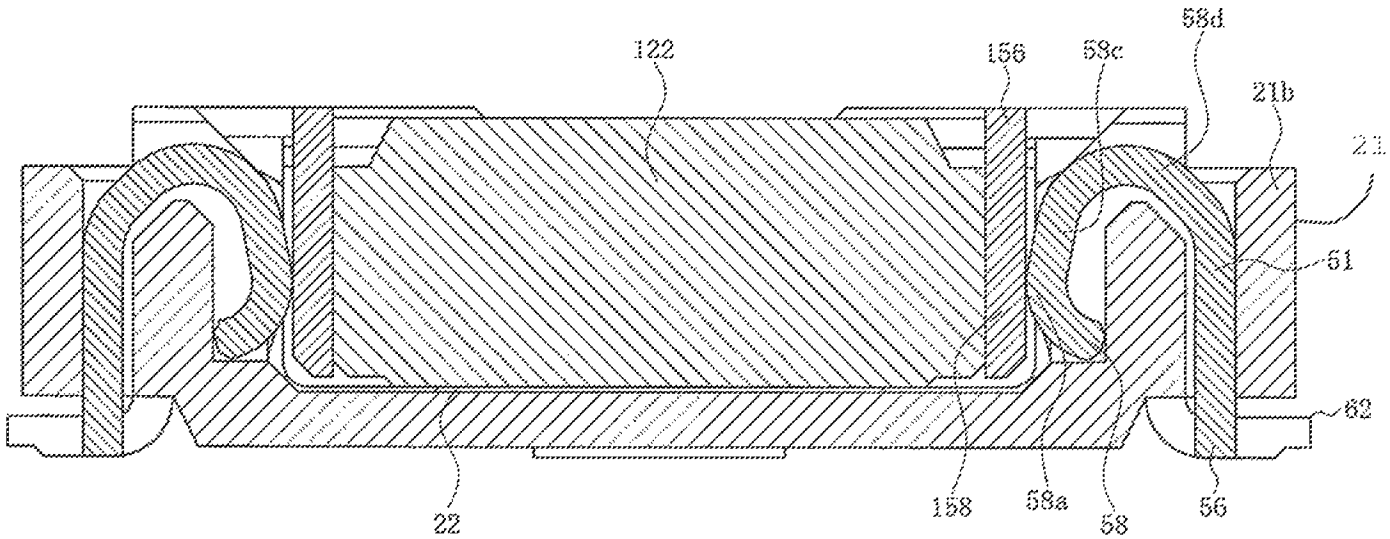
FIG. 9 is a cross-sectional view at Arrows B-B of FIG. 7 illustrating an enlargement of a portion of the first connector and second connector fit to each other.
Figure 11B:
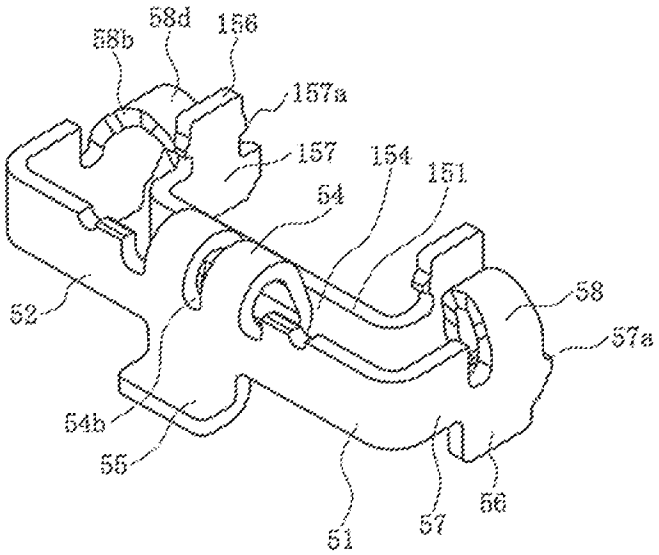
FIG. 11 is a perspective view illustrating the relationship between the first reinforcing metal fitting and the second reinforcing metal fitting in the state in which the first connector and the second connector are fit to each other, according to Embodiment 1 of the Present Disclosure, where (a) is an oblique view with the first reinforcing metal fitting front-upward and (b) is an oblique view with the first reinforcing metal fitting back-upward.
Figure 11A:
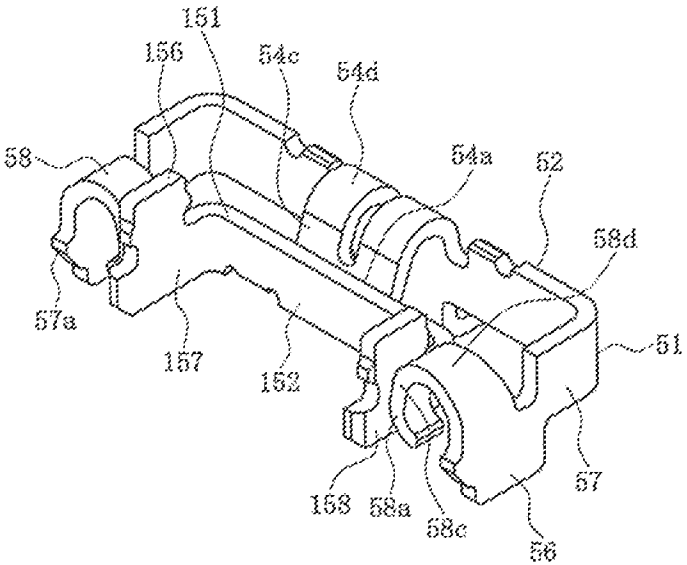
Figure 12:
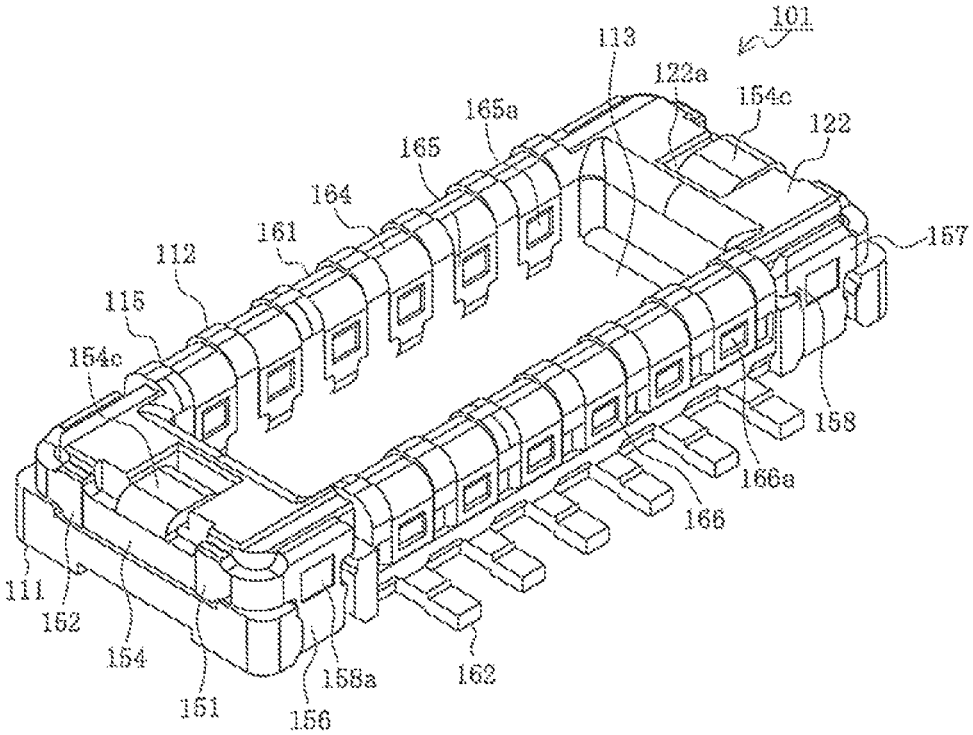
FIG. 12 is a perspective view of a second connector, according to Embodiment 2 of the Present Disclosure, from the side of the fitting surface.
Figure 13:
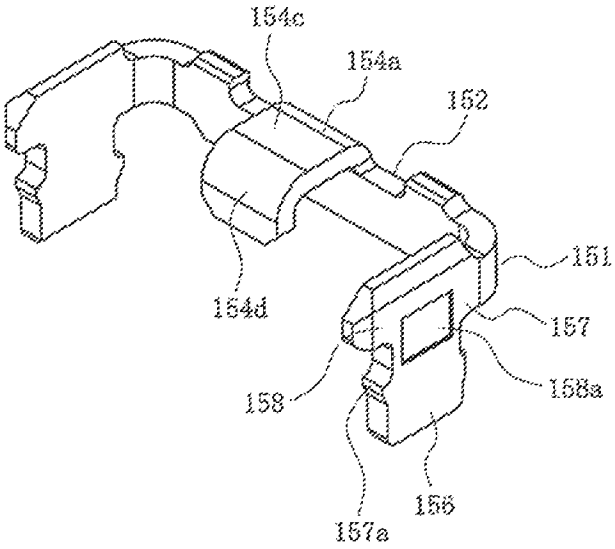
FIG. 13 is a perspective view of a second reinforcing metal fitting, according to Embodiment 2 of the Present Disclosure, from the side of the fitting surface.
Figure 13:
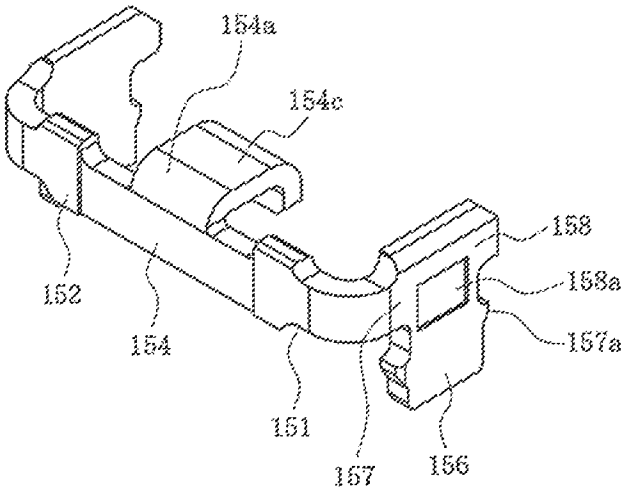
Figure 14A:
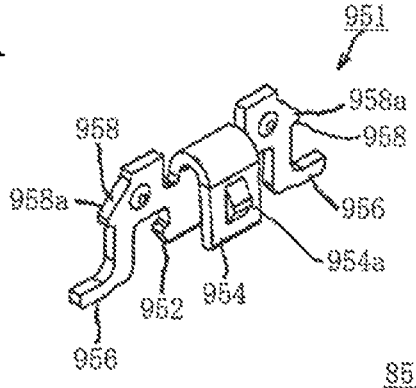
FIGS. 14(*a*) and (*b*) are perspective views of a conventional connector, in which FIG. 14(*a*) is a conventional second reinforcing metal fitting and FIG. 14(*b*) is a conventional first reinforcing metal fitting.
Figure 14B:
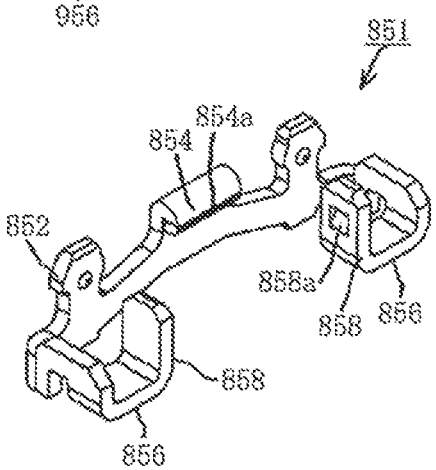

In addition, as shown in FIGS. 8-9 and 11, the first reinforcing metal fitting 51 provided upon the first connector 1 and the second reinforcing metal fitting 151 provided upon the second connector 101 engage each other. Thereby, the first reinforcing metal fitting 51 and the second reinforcing metal fitting 151 are put into a state of electrical continuity. Note that in FIG. 11, the first housing 11, second housing 111, first terminals 61 and second terminals 161 are omitted from the Figure in order to clarify the relationship between the first reinforcing metal fitting 51 and the second reinforcing metal fitting 151.

In more detail, when the second reinforcing metal fitting 151 is inserted into the inside of the first reinforcing metal fitting 51, the lower curved portions 58*a* of the left and right first lateral contact arm portions 58 of the first reinforcing metal fitting 51 come into contact with the left and right second lateral contact arm portions 158 of the second reinforcing metal fitting 151, and the lower curved portion 54*a* of the first central contact arm portion 54 of the first reinforcing metal fitting 51 comes into contact with the second central contact arm portion 154 of the second reinforcing metal fitting 151. In this case, the first lateral contact arm portion 58 itself functions as a spring portion, and mainly the connection arm portion 58*c* and upper curved portion 58*d* function as a spring portion, thus causing the surface of the lower curved portion 58*a* to be pressed against the surface of the second lateral contact arm portion 158, and also the first central contact arm portion 54 itself functions as a spring portion, and mainly the connection arm portion 54*c* and upper curved portion 54*d* function as a spring portion, thus causing the surface of the lower curved portion 54*a* to be pressed against the surface of the second central contact arm portion 154.

Thereby, the second reinforcing metal fitting 151 is solidly held by the first reinforcing metal fitting 51, preventing the second reinforcing metal fitting 151 from separating from the first reinforcing metal fitting 51, so the first connector 1 and second connector 101 are reliably kept fit together. In addition, the contact between the surface of the lower curved portion 58*a* and the surface of the second lateral contact arm portion 158, and the contact between the surface of the lower curved portion 54*a* and the surface of the second central contact arm portion 154 are reliably maintained so the electrical continuity between the first reinforcing metal fitting 51 and the second reinforcing metal fitting 151 is reliably maintained.

Note that by fitting the first reinforcing metal fitting 51 and second reinforcing metal fitting 151 together, rubbing occurs with the surface of the lower curved portion 58*a* pressed against the surface of the second lateral contact arm portion 158, and also rubbing occurs with the surface of the lower curved portion 54*a* pressed against the surface of the second central contact arm portion 154. Accordingly, this prevents foreign matter from being caught between the lower curved portion 58*a* and the second lateral contact arm portion 158, and between the lower curved portion 54*a* and the second central contact arm portion 154, so no contact faults will occur. In addition, the surface of the second lateral contact arm portion 158 and the surface of the second central contact arm portion 154 are planar, so the rubbing distance is long, and namely the amount of rubbing becomes large. Accordingly, this has the effect of cleaning between the lower curved portion 58*a* and the second lateral contact arm portion 158, and between the lower curved portion 54*a* and the second central contact arm portion 154, preventing contact faults.

In this manner, the conductive traces of the first board connected to the first lateral board connection portion 56 and the first central board connection portion 55 of the first reinforcing metal fitting 51 via connection pads achieve electrical continuity with the conductive traces of the second board connected to the second lateral board connection portion 156 of the second reinforcing metal fitting 151 via connection pads. In this case, there is multipoint contact, or specifically contact at three points, between the first reinforcing metal fitting 51 and the second reinforcing metal fitting 151, so the state of electrical continuity is reliably maintained. In addition, the contact resistance between the first reinforcing metal fitting 51 and the second reinforcing metal fitting 151 also drops. Accordingly, if the conductive traces are power lines, then for example, even if a current of a magnitude of roughly 1-3 A flows between the conductive trace of the first board and the conductive trace of the second board, the contact resistance is low, so no large amounts of heat are generated between the first reinforcing metal fitting 51 and the second reinforcing metal fitting 151. Moreover, there is multipoint contact between the first reinforcing metal fitting 51 and the second reinforcing metal fitting 151, so it is possible to prevent the generation of large amounts of heat because the current is divided.

Note that the connection arm portion 54*c* and upper curved portion 54*d* are wider than the connection arm portion 58*c* and upper curved portion 58*d*, so they generate a greater pressing force than the connection arm portion 58*c* and upper curved portion 58*d*. This is because while the positioning of the second connector 101 in regard to the width direction of the first connector 1 is done not only by means of the first lateral contact arm portion 58 but also by means of a plurality of first terminals 61, the positioning of the second connector 101 in regard to the longitudinal direction of the first connector 1 is mainly done by means of the first central contact arm portion 54 of the first reinforcing metal fitting 51 disposed at both ends of the first connector 1 in the longitudinal direction.

The magnitude of the pressing force generated by this first central contact arm portion 54 is adjusted by means of the flexibility-providing portion 54*b*. As described above, the presence of this flexibility-providing portion 54*b* substantially reduces the width dimension of the connection arm portion 54*c* and upper curved portion 54*d*, so the spring force is reduced, and as a result the pressing force generated by the first central contact arm portion 54 is reduced. Note that by adjusting the width and length of the flexibility-providing portion 54*b*, it is possible to adjust the degree of reduction in the pressing force generated by the first central contact arm portion 54.

Moreover, as described above, the presence of the flexibility-providing portion 54*b* increases the flexibility of the connection arm portion 54*c* and the upper curved portion 54*d*, so that the lower curved portion 54*a* can be flexibly displaced, so the contact with the second central contact arm portion 154 of the second reinforcing metal fitting 151 can be reliably maintained. In particular, the upper curved portion 54*d* is a curved portion provided with a large radius of curvature, so its flexibility is great and thus elastic deformation is possible over a wide range. In addition, as shown in FIG. 8, when the first connector 1 and second connector 101 are fit together, it is preferable for the free end of the first central contact arm portion 54 to be touching the end-wall portion 21*c* of the first housing 11. Thereby, there will be no occurrence of the so-called phenomenon of fatigue wherein the first central contact arm portion 54 becomes permanently deformed and loses its function as a spring portion.

Moreover, the first central contact arm portion 54 is a belt-shaped plate member, so the surface of the lower curved portion 54*a* is the surface of a belt-shaped plate member, and thus the it extends in the width direction of the plate member, or namely in the width direction of the first connector 1 when viewed from the fitting surface side, and is in linear contact over a wide range with the second central contact arm portion 154 of the second reinforcing metal fitting 151 which is a plane extending in the width direction of the second connector 101. Accordingly, the contact resistance between the lower curved portion 54*a* and the second central contact arm portion 154 is low, and the electrical continuity state can be maintained reliably.

Furthermore, the surface of the lower curved portion 54*a* is a curved convex surface, but it is a smooth surface like the surface of the second central contact arm portion 154. For this reason, when electronic equipment in which the first circuit board and second circuit board is mounted falls or is subject to external forces, giving rise to vibration or shock, this may be conveyed but even in the case of displacement of the second reinforcing metal fitting 151 relative to the first reinforcing metal fitting 51, and even if the surface of the lower curved portion 54*a* and the surface of the second central contact arm portion 154 rub against each other, it is still possible to maintain contact and there will be no occurrence of the phenomenon called the momentary short in which there is a momentary break in the electrical continuity between the lower curved portion 54*a* and the second central contact arm portion 154.

Assuming the case in which a protrusion is formed on one of the lower curved portion 54*a* or the second central contact arm portion 154 and an indentation is formed on the other, and the protrusion and indentation fit together between the lower curved portion 54*a* and second central contact arm portion 154, when vibration or shock is conveyed, the protrusion may move within the indentation, or come in and out of the indentation, so at this time, there is a possibility of a momentary short occurring as the surfaces of the protrusion and indentation are temporarily separated. However, in this embodiment, as described above, the surface of the lower curved portion 54*a* and the surface of the second central contact arm portion 154 are smooth surfaces, so there will be no occurrence of momentary shorts.

The magnitude of the pressing force generated by the first lateral contact arm portion 58 is adjusted by the flexibility-providing portion 58*b*. As described above, the width dimensions of the connection arm portion 58*c* and upper curved portion 58*d* are reduced by the presence of this flexibility-providing portion 58*b*, so the spring force is decreased and as a result the pressing force generated by the first lateral contact arm portion 58 is reduced. Note that by adjusting the width and length of the flexibility-providing portion 58*b*, it is possible to adjust the degree of reduction of the pressing force generated by the first lateral contact arm portion 58.

Moreover, as described above, the flexibility of the connection arm portion 58*c* and upper curved portion 58*d* is increased by the presence of the flexibility-providing portion 58*b*, and flexible displacement of the lower curved portion 58*a* becomes possible, so it is possible to reliably maintain the contact with the second lateral contact arm portion 158 of the second reinforcing metal fitting 151. In particular, the upper curved portion 58*d* is a curved portion provided with a large radius of curvature, so its flexibility is great and flexible deformation is possible over a wide range. In addition, as shown in FIG. 9, when the first connector 1 and second connector 101 are fit together, it is preferable for the free end of the first lateral contact arm portion 58 to be touching the side-wall extension portion 21*b* of the first housing 11. Thereby, there will be no occurrence of the so-called phenomenon of fatigue wherein the first lateral contact arm portion 58 becomes permanently deformed and loses its function as a spring portion.

Moreover, the first lateral contact arm portion 58 is a belt-shaped plate member, so the surface of the lower curved portion 58*a* is the surface of a belt-shaped plate member, and thus the it extends in the width direction of the plate member, or namely in the width direction of the first connector 1 when viewed from the fitting surface side, and is in linear contact over a wide range with the second lateral contact arm portion 158 of the second reinforcing metal fitting 151 which is a plane extending in the width direction of the second connector 101. Accordingly, the contact resistance between the lower curved portion 58*a* and the second lateral contact arm portion 158 is low, and the electrical continuity state can be maintained reliability.

Furthermore, the surface of the lower curved portion 58*a* is a curved convex surface, but it is a smooth surface like the surface of the second lateral contact arm portion 158. For this reason, in the same manner as in the case of the lower curved portion 54*a* and second central contact arm portion 154, even when vibration or shock may be conveyed, it is still possible to maintain contact and there will be no occurrence of momentary shorts.

Moreover, as is evident from FIGS. 8-9, the position of the start of contact between the lower curved portion 54*a* and the second central contact arm portion 154 is closer to the fitting surface of first connector 1 (further upward in FIGS. 8-9) than the position of the start of contact between the lower curved portion 58*a* and the second lateral contact arm portion 158. For this reason, in the process of the first connector 1 and second connector 101 fitting together, when the second thrust end portion 122 of the second connector 101 is inserted within the thrust end indentation 22 of the first connector 1, contact starts first between the lower curved portion 54*a* and the second central contact arm portion 154 and then contact starts between the lower curved portion 58*a* and the second lateral contact arm portion 158. To wit, the contact between the lower curved portion 54*a* and the second central contact arm portion 154 and the contact between the lower curved portion 58*a* and the second lateral contact arm portion 158 do not start simultaneously. Accordingly, the force required to insert the second thrust end portion 122 of the second connector 101 within the thrust end indentation 22 of the first connector 1, or namely the fitting force required to fit the first connector 1 and second connector 101 together becomes smaller and thus the fitting-together work can be done more easily.

In addition, as is evident from FIGS. 8-10, the position of the start of contact between the first terminals 61 and the second terminals 161 is closer to the fitting surface of first connector 1 (further upward in FIGS. 8-10) than the position of the start of contact between the first reinforcing metal fitting 51 and the second reinforcing metal fitting 151. For this reason, in the process of the first connector 1 and second connector 101 fitting together, when the second protrusion 112 and second thrust end portion 122 of the second connector 101 are inserted within the trench 12*a* and thrust end indentation 22 of the first connector 1, contact starts first between the first terminals 61 and the second terminals 161 and then contact starts between the first reinforcing metal fitting 51 and the second reinforcing metal fitting 151. To wit, the contact between the first reinforcing metal fitting 51 and the second reinforcing metal fitting 151 and the contact between the first terminals 61 and the second terminals 161 do not start simultaneously. Accordingly, the force required to insert the second thrust end portion 122 of the second connector 101 within the trench 12*a* and the thrust end indentation 22 of the first connector 1, or namely the fitting force required to fit the first connector 1 and second connector 101 together becomes smaller and thus the fitting-together work can be done more easily.

Moreover, the first lateral contact arm portion 58 and first lateral board connection portion 56 of the first reinforcing metal fitting 51 connect to the first side-plate portion 57 at roughly the same position when viewed from the fitting surface side. Accordingly, there is only a short conducting distance within the first reinforcing metal fitting 51 between the point of contact between the lower curved portion 58*a* and the second lateral contact arm portion 158 and the point of contact between the first lateral board connection portion 56 and the connection pad of the first board, so the conducting resistance is low and even if a large current flows, no great amount of heat will be generated at the first reinforcing metal fitting 51.

In the same manner, the first central contact arm portion 54 and first central board connection portion 55 of the first reinforcing metal fitting 51 connect to the first main body 52 at roughly the same position when viewed from the fitting surface side. Accordingly, there is only a short conducting distance within the first reinforcing metal fitting 51 between the point of contact between the lower curved portion 54*a* and the second central contact arm portion 154 and the point of contact between the first central board connection portion 55 and the connection pad of the first board, so the conducting resistance is low and even if a large current flows, no great amount of heat will be generated at the first reinforcing metal fitting 51. In addition, the second lateral contact arm portion 158 and second lateral board connection portion 156 of the second reinforcing metal fitting 151 connect to the second side-plate portion 157 at roughly the same position when viewed from the fitting surface side. Accordingly, there is only a short conducting distance within the second reinforcing metal fitting 151 between the point of contact between the second lateral contact arm portion 158 and the lower curved portion 58*a* and the point of contact between the second lateral board connection portion 156 and the connection pad of the second board, so the conducting resistance is low and even if a large current flows, no great amount of heat will be generated at the second reinforcing metal fitting 151.

Note that in the illustrated example, the second reinforcing metal fitting 151 is not provided with a board connection portion formed at the same position as that of the second central contact arm portion 154. For this reason, the current within the second reinforcing metal fitting 151 will flow from the point of contact between the second central contact arm portion 154 and the lower curved portion 54*a* to the point of contact between the second lateral board connection portion 156 and the connection pad of the second board. However, the second reinforcing metal fitting 151 is formed so as to be positioned on the inside of the first reinforcing metal fitting 51, so the overall dimensions are small and accordingly the conducting distance is also short from the point of contact between the second central contact arm portion 154 and the lower curved portion 54*a* and the point of contact between the second lateral board connection portion 156 and the connection pad of the second board. As such, even if a large current flows, no great amount of heat will be generated at the second reinforcing metal fitting 151. Note that if necessary, a board connection portion like that of the second lateral board connection portion 156 may be formed at the same position as that of the second central contact arm portion 154.

In this manner, in this embodiment, the connector includes (1) a first connector 1 comprising a first terminal 61 and a first housing 11 that includes a first thrust end portion 21 formed at each end in the longitudinal direction; and (2) a second connector 101 comprising a second terminal 161 that contacts the first terminal 61 and a second housing 111 that includes a second thrust end portion 122 formed at each end in the longitudinal direction that fits to the first thrust end portion 21. A first reinforcing metal fitting 51 and a second reinforcing metal fitting 151 are attached to the first thrust end portion 21 and the second thrust end portion 122. The second reinforcing metal fitting 151 includes a second main body portion 152 extending in the width direction of the second housing 111, and a pair of second side-plate portions 157 that are connected to either end of the second main body portion 152 and that extend in the longitudinal direction of the second housing 111. The first reinforcing metal fitting 51 includes a first main body portion 52 extending in the width direction of the first housing 11, a pair of first side-plate portions 57 that are connected to either end of the first main body portion 52 and that extend in the longitudinal direction of the first housing 11, and a first central contact arm portion 54 and a first lateral contact arm portion 58 that each connect to the first main body portion 52 and the first side-plate portion 57, respectively. Each of the first central contact arm portion 54 and first lateral contact arm portion 58 includes an upper curved portion 54*d* or 58*d*, a lower curved portion 54*a* or 58*a*, a connection-arm portion 54*c* or 58*c* that connects the upper curved portion 54*d* or 58*d* and lower curved portion 54*a* or 58*a*, and a flexibility-providing portion 54*b* or 58*b* that reduces at least part of the width dimension of the upper curved portion 54*d* or 58*d* and the connection-arm portion 54*c* or 58*c*, and the curved convex surface of the lower curved portion 54*a* or 58*a* is pressed against the surfaces of the second main body portion 152 and second side-plate portion 157 of the second reinforcing metal fitting 151.

Thereby, it is possible to give the first central contact arm portion 54 and first lateral contact arm portion 58 of the first reinforcing metal fitting 51 great flexibility and also, a large contact surface area can be secured between the lower curved portion 54*a* or 58*a* and the second main body 152 and second side-plate portion 157 of the second reinforcing metal fitting 151. As a result, the state of engagement between the first reinforcing metal fitting 51 and second reinforcing metal fitting 151 can be reliably maintained and also the state of electrical continuity between the first reinforcing metal fitting 51 and the second reinforcing metal fitting 151 can be reliably maintained and the first connector 1 and second connector 101 can be reliably kept fit together, so reliability can be improved.

In addition, the first reinforcing metal fitting 51 further comprises a first central board connection portion 55 and first lateral board connection portion 56 that each have one end connected to a conductive trace of a board and the other end connected to each of the first main body portion 52 and the first side-plate portion 57, respectively. The other ends of the first central board connection portion 55 and first lateral board connection portion 56 are each connected to the first main body portion 52 and first side-plate portion 57, respectively, at the same positions as the first central contact arm portion 54 and first lateral contact arm portion 58 when viewed from the side of the fitting surface of the first connector 1. Accordingly, there is only a short conducting distance within the first reinforcing metal fitting 51 between the point of contact between the lower curved portion 58*a* and the second lateral contact arm portion 158 and the point of contact between the first lateral board connection portion 56 and the connection pad of the first board, so the conducting resistance is low and even if a large current flows, no great amount of heat will be generated at the first reinforcing metal fitting 51.

Moreover, the first central contact arm portion 54 and first lateral contact arm portion 58 are made of belt-like plate members, and the curved convex surfaces of the lower curved portions 54*a*, 58*a* extend in the width direction of the plate member and are in linear contact with the surfaces of the second main body portion 152 and the second side-plate portion 157 of the second reinforcing metal fitting 151. Accordingly, the contact resistance between the lower curved portion 54*a*, 58*a* and the second main body 152 and second side-plate portion 157 is low, and the electrical continuity state can be maintained reliability.

Moreover, the flexibility-providing portion 58*b* of the first lateral contact arm portion 58 connected to the first side-plate portion 57 is formed upon at least part of the side edges of the upper curved portion 58*d* and connection-arm portion 58*c*, and at least a portion of the width dimensions of the upper curved portion 58*d* and connection-arm portion 58*c* decrease upon getting closer to the lower curved portion 58*a*. Thereby, flexible displacement of the lower curved portion 58*a* becomes possible, so it is possible to reliably maintain the contact with the second lateral contact arm portion 158 of the second reinforcing metal fitting 151.

With regard to Embodiment 2 of the Present Disclosure, note that those elements having the same structure as those in Embodiment 1 will be given the same symbols and their explanation will be omitted. In addition, explanation of the same operations and the same effects as in Embodiment 1 above will also be similarly omitted. In this embodiment, the second terminals 161 of the second connector 101 each comprise a main body portion (not shown), a tail portion 162 connected to the lower end of the main body portion, a first contact portion 165 connected to the upper end of the main body portion, a connection portion 164 connected to the upper end of the first contact portion 165 and a second contact portion 166 connected to the outer end of the connection portion 164. Note that a first contact indentation 165*a* that engages the first contact portion 65 of the first terminals 61 is formed on the surface of the first contact portion 165, while a second contact indentation 166*a* that engages the second contact portion 66 of the first terminals 61 is formed on the surface of the second contact portion 166.

The second terminals 161 are integral with the second housing 111. For example, the second housing 111 is formed by injecting resin into a cavity of a mold into which the second terminals 161 had been placed in advance. Thereby, the second terminals 161 have their main bodies buried within the second housing 111, and are integrated into the second housing 111 with the surfaces of the first contact portion 165, connection portion 164 and second contact portion 166 exposed to the side surfaces of the second protrusion 112 and the fitting surface.

In addition, the second reinforcing metal fitting 151 of the second connector 101 in this embodiment is provided with a curved arm portion 154*c* connected to the upper end of the second main body 152 in the center. This curved arm portion 154*c* is a member provided with a substantially U-shaped overall side-surface shape, including a base-end curved portion 154*a* connected to the second main body 152 and a tip-end curved portion 154*d* positioned toward the front tip. Moreover, in the state in which the second reinforcing metal fitting 151 is attached to the second thrust end portion 122 of the second housing 111, the curved arm portion 154*c* is enclosed within an indentation 122*a* formed on the upper surface of the second thrust end portion 122. In addition, a lateral contact indentation 158*a* which engages the first lateral contact arm portion 58 of the first reinforcing metal fitting 51 is formed upon the second lateral contact arm portion 158 of the second reinforcing metal fitting 151.

Note that the constitution of the other elements of second connector 101 is identical to those of Embodiment 1 above. In addition, the first connector 1 is identical to that in Embodiment 1 above. Furthermore, the operation of the first connector 1 and second connector 101 fitting together and the meritorious effects thereof are identical to those of Embodiment 1 above. Accordingly, explanations thereof are omitted.

While a preferred embodiment of the Present Disclosure is shown and described, it is envisioned that those skilled in the art may devise various modifications without departing from the spirit and scope of the foregoing Description and the appended Claims.

What is claimed is:

1. A connector, the connector comprising:

a first connector, the first connector comprising a first terminal and a first housing that includes a first fitting guide portion formed at each end thereof in the longitudinal direction; and a second connector, the second connector comprising a second terminal that contacts the first terminal and a second housing that includes a second fitting guide portion formed at each end thereof in the longitudinal direction and that fits to the first fitting guide portion;

wherein:

a first reinforcing metal fitting and a second reinforcing metal fitting are attached to the first fitting guide portion and the second fitting guide portion, respectively;

the second reinforcing metal fitting includes a second main body portion extending in the width direction of the second housing, and a pair of second side-plate portions connected to either end of the second main body portion and extend in the longitudinal direction of the second housing;

the first reinforcing metal fitting includes a first main body portion extending in the width direction of the first housing, a pair of first side-plate portions connected to either end of the first main body portion and extend in the longitudinal direction of the first housing, and contact-arm portions connected to the first main body portion and first side-plate portions, respectively; and each contact-arm portion includes an upper curved portion, a lower curved portion, a connection-arm portion that connects the upper curved portion and lower curved portion, and a flexibility-providing portion that reduces at least part of the width dimension of the upper curved portion and connection-arm portion, a curved convex surface of the lower curved portion is being pressed against the surfaces of the second main body portion and second side-plate portion of the second reinforcing metal fitting.

2. The connector of claim 1, wherein the first reinforcing metal fitting further includes a board connection portion having one end connected to a conductive trace of a board and the other end connected to each of the first main body portion and the side-plate portion.

3. The connector of claim 2, wherein the ends of the board connection portion are connected to the first main-body portion and first side-plate portion at the same positions as the connection-arm portions when viewed from the side of the fitting surface of the first connector.

4. The connector of claim 3, wherein the contact-arm portion is made of a belt-like plate member.

5. The connector of claim 4, wherein the curved convex surface of the lower curved portion extends in the width direction of the plate member.

6. The connector of claim 5, wherein the curved convex surface of the lower curved portion is in linear contact with the second main body portion and second side-plate portion of the second reinforcing metal fitting.

7. The connector of claim 6, wherein the flexibility-providing portion of the contact-arm portion connected to the first side-plate portion is formed upon at least part of the side edges of the upper curved portion and connection-arm portion.

8. The connector of claim 7, wherein a portion of the width dimensions of the upper curved portion and connection-arm portion decrease upon getting closer to the lower curved portion.

9. The connector of claim 8, wherein the upper curved portion and connection-arm portion of the contact-arm portion connected to the first side-plate portion are wider than the upper curved portion and connection-arm portion of the contact-arm portion to which each is connected in the first side-plate portion, thereby producing an even greater pressing force.

10. The connector of claim 9, wherein the flexibility-providing portion of the contact-arm portion connected to the first side-plate portion is formed partially in the center in the width direction of the upper curved portion and connection-arm portion, being a long, thin, slit-shaped opening extending in the longitudinal direction of the contact-arm portion.

11. The connector of claim 10, wherein the distance from the start of contact of the curved convex surface of the lower curved portion of the contact-arm portion connected to the first main body portion with the surface of the second main body portion of the second reinforcing metal fitting to the fitting surface of the first connector is different from the distance from the start of contact of the curved convex surface of the lower curved portion of the contact-arm portion connected to each of the first side-plate portions with the surface of the second side-plate portion of the second reinforcing metal fitting to the fitting surface of the first connector.

* * * * *